United States Patent [19]

Prodel

[11] 4,067,474

[45] Jan. 10, 1978

[54] PLASTIC BOTTLE CASE

[75] Inventor: Ulrich Prodel, Bad Salzuflen, Germany

[73] Assignee: Spumalit-Anstalt, Germany

[21] Appl. No.: 757,515

[22] Filed: Jan. 7, 1977

[30] Foreign Application Priority Data

Jan. 15, 1976 Germany ..... 2601422

[51] Int. Cl.[2] ..... B65D 1/24; B65D 75/00; B65D 85/00

[52] U.S. Cl. ..... 220/21; 206/203; 206/427; 217/19

[58] Field of Search ..... 220/21; 206/196, 194, 206/203, 427, 507; 217/19, 21

[56] References Cited

U.S. PATENT DOCUMENTS

| | | | |
|---|---|---|---|
| 3,986,628 | 10/1976 | Prodel | 220/21 |
| 3,998,328 | 12/1976 | Box | 220/21 X |

*Primary Examiner*—George T. Hall

*Attorney, Agent, or Firm*—Robert E. Burns; Emmanuel J. Lobato; Bruce L. Adams

[57] ABSTRACT

A plastic bottle case for holding two rows of bottles has two inner walls which extend between opposite ends of the case and slope upwardly and inwardly at an acute angle to one another. Lower edges of the inner walls are spaced inwardly from the respective sides of the case a distance less than the diameter of bottles to be received in the case. Openings having horizontal projections conforming to the cross sectional shape of the bottles are provided in the inner walls to receive the bottles so as to hold them erect and keep them from bumping one another. The bottles are supported by ledges at the bottoms of the openings in the inner walls, the bottom of the case being otherwise open. This construction permits a saving in weight and hence in the amount of plastic material required for the bottle case. A further saving of material is achieved by making the sides and ends of the case of vertically spaced horizontal bands extending between angular columns at the corners of the case.

13 Claims, 12 Drawing Figures

PLASTIC BOTTLE CASE

FIELD OF INVENTION

The present invention relates to plastic bottle cases for holding full or empty bottles and particularly to a case for holding two rows of bottles.

BACKGROUND OF INVENTION

Plastic bottle cases for holding two rows of bottles are mostly designed for six or eight bottles. Primarily they serve for transporting one liter bottles of the soft drink industry. However, they can also serve as bottle carriers for substantially smaller bottles, for example beer bottles.

There are a large number of bottle carriers and bottles cases of this kind. There is a still larger number of bottles cases designed for the transport of a larger number of bottles, for example twenty, twenty-four or thirty bottles. In order to hold bottles in such bottle cases and bottle carriers securely so that they will not hit and damage one another during transport, a large number of solutions have been proposed. Initially there were provided crossing inner walls so as to form a compartment for each bottle and thereby hold each bottle upright during transport and at the same time assure that the bottles during transport do not strike one another but only the partition walls. Even today, bottle cases of this kind are in wide use.

Moreover, for a special purpose namely for transporting bottles packed in carriers or "packs" and also individual bottles, plastic bottle cases are known which for each row of bottles have two inclined inner walls provided with elliptical openings to receive the bottles with bottle supporting bars at the bottoms of the openings. Bottle carriers adapted to be received in the case have side walls which are inclined in the same manner as the inner walls of the case. Individual bottles are received in the openings of the inner walls so as to hold them upright and keep them from bumping one another.

A particular problem has arisen today by reason of the sharp increase in the cost of the plastic material of which bottle cases are made. By reason of the high cost of the plastic material, it is important to make the bottle cases as light as possible so as to require a minimum amount of material while at the same time assuring stability of the case and proper support for the bottles.

SUMMARY OF INVENTION

It is accordingly an object of the present invention to provide a bottle case which is lightweight and hence which requires a minimum amount of material for its construction while at the same time assuring stability of the case and providing proper support for the bottles so that they cannot strike and damage one another during transport. The invention is particularly applicable to a plastic bottle case in which the bottles are arranged in two rows.

In accordance with the invention, a plastic bottle case for two rows of bottles is provided with two inner walls which are arranged at an acute angle to one another and which extend between the ends of the case. These inner walls have semi-elliptical openings to receive the bottles with ledges at the bottoms of the openings to support the bottles in the case.

In this manner there is achieved a bottle case which instead of having a full bottom or a bottom formed of a grid of crossing bars has only a single supporting ledge or bar for each row of bottles. Also, in comparison with the previously known bottle case the number of inner walls is sharply reduced, namely to half the number. This achieves an important economy in the amount of plastic material required for making the case. This economy of material is achieved without impairing the support provided for the bottles. In accordance with the invention, the bottles are supported in such manner that they are spaced apart and cannot strike one another during the handling and transport of the bottle case.

Expediently, the two inner walls are spaced from one another so as to accommodate between them a mold part for forming in the same molding operation a handle which is located above the space between the inner walls and which extends between the opposite ends of the case. Thus, the handle extends longitudinally of the case and thus in position to be conveniently held to carry the bottle case. By making the handle of channel cross section, it can be made of a minimum amount of material while yet providing adequate strength.

A further economy of material in the outer walls can be attained by making the bottle case in the form of an open frame comprising four angular corner columns and forming each side of at least three horizontal bars or from a half wall and one bar. The construction of the bottle case out of three bars gives the further possibility of displaying on the bars the company name of the bottle packer for advertising purposes. There is likewise the possibility of seeing the interior of the bottle case and hence labels on the bottles. The information on the bottle labels can thus be read without removing the bottles from the case. This is particularly important when bottles having different contents are packed in the same case, for example orangeade and lemonade bottles.

In order to position the bottles as close together as possible so as to reduce the dimensions of the bottle case and hence the amount of raw material required for making the bottle case while providing greater stability, it is advantageous to provide on the inside of the middle band on the sides of the case inwardly extending projections of triangular or trapezoidal shape which serve effectively to position the bottles so that the bottles can be closer together without hitting one another. If desired, the angular or trapezoidal projections can be provided with short inner wall portions which extend inwardly into the interior of the casing so as to be between adjacent bottles.

To facilitate insertion of bottles into the case particularly with automatic packing machines, the upper edges of the angular or trapezoidal projections preferably slope downwardly and inwardly.

For the purpose of assuring very exact positioning of the bottles in the bottle case, inwardly projecting angular or trapezoidal projections can be provided also on the lower bands at the sides of the case. Moreover, these can also carry a further bottom ledge which extends from one end of the case to the other when this is considered desirable.

It is also possible to provide on the lower bands of the sides of the case triangular or trapezoidal projections preferably in pairs which can carry a further bottom ledge in case this is desirable for supporting very heavy bottles.

The bottom ledges need not be continuous but can consists of short bars which are carried by the inner walls. The use of such bars has not only the advantage of an economy of material but also the further advantage that bottles of a size smaller than that for which the case is intended will drop out through the bottom of the case.

BRIEF DESCRIPTION OF DRAWINGS

The nature, objects and advantages of the invention will be more fully understood from the following description in conjunction with the accompanying drawings which show schematically preferred embodiments of the invention. In the drawings.

Figure 1:
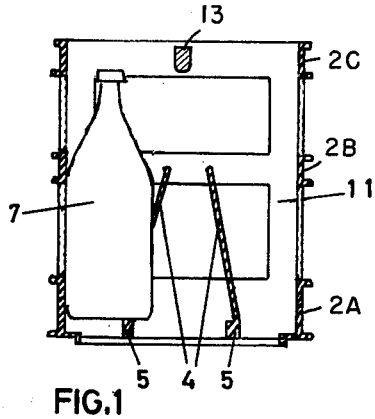
FIG. 1 is a cross section of a plastic bottle case in accordance with the invention, one bottle being shown in position in the case.
Figure 2:
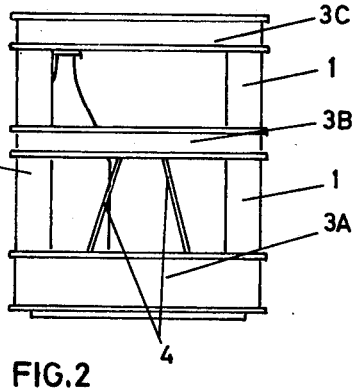
FIG. 2 is an end elevation of the case.
Figure 3:
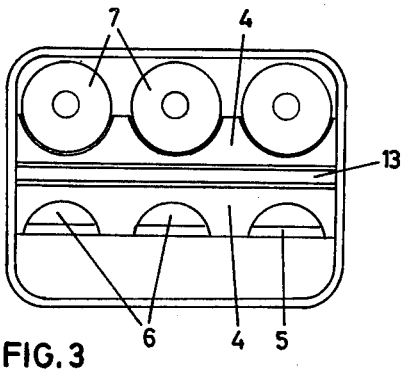
FIG. 3 is a plan view.
Figure 4:
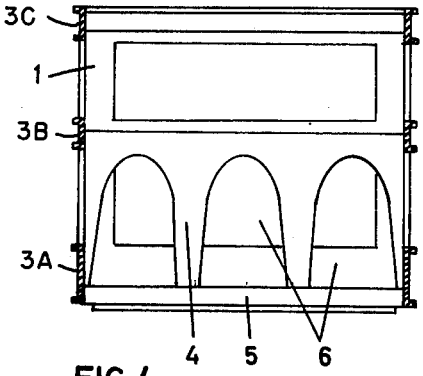
FIG. 4 is a longitudinal section.
Figure 5:
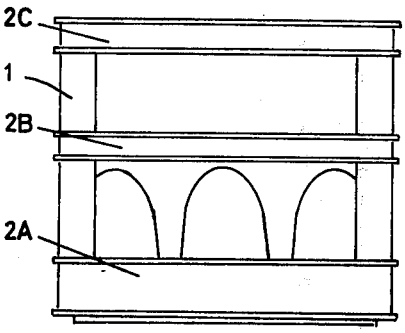
FIG. 5 is a side elevation of the case.

DESCRIPTION OF PREFERRED EMBODIMENTS:

The bottle cases shown in the drawings are molded in one piece from plastic material. Hence, all parts of the case are integral with one another.

In the embodiment of the invention shown in FIGS. 1 to 5, the bottle case is constructed as a frame comprising four corner columns of angular cross section joined by three horizontal hands 2A, 2B and 2C on the longer sides and three horizontal bands 3A, 3B and 3C at the ends. The bands are of outwardly facing channel cross section with outwardly projecting flanges at their upper and lower edges. Moreover, the lower bands 2A and 3A have at their lower edges inwardly extending flanges with downwardly projecting lips at their inner edges.

Inside the bottle case there are two inner walls 4 which extend from one end of the case to the other and are inclined upwardly and inwardly at an acute angle to one another. At the lower edges of the inner walls 4, there are bottom flanges or ledges 5 of greater thickness than the walls. The inner walls have openings 6 to receive individual bottles. In elevation, the openings 6 are parti-elliptical while in plan view they are parti-circular with a diameter slightly larger than than of the bottles to be received in the case. The bottom ledges 5 extend across the bottoms of the openings 6 so as to support the bottles received in the openings since the bottom of the case is otherwise open, there being no solid bottom or grid as in conventional construction. The lower edges of the inner walls 4 are spaced from the sides of the case a distance which is not less than the diameter of the bottles and not greater than about three-fourths the diameter so that the bottom ledges 5 come well under the bottles and support them. The upper edges of the inner walls 4 are spaced inwardly from the sides of the case a distance greater than the diameter of the bottles for which the case is intended and are spaced apart from one another sufficiently to accommodate a mold part to form the lower surface of a handle 13 when the case is being molded. The handle 13 extends longitudinally the full length of the case from one upper end band 3C to the other. It may be of solid cross section as illustrated in FIG. 1 or of upwardly opening channel section. The inner walls 4 extend upwardly from the bottom of the case to a height at least half the height of the case so as to join the middle end bands 3B. The height and inclination of the inner walls 4 must be such that the curved upper edges of the openings 6 engage the cylindrical parts of the bottles and there must be sufficient material above the openings 6 to provide adequate strength for the inner walls.

By being received in the openings 6 in the inner walls 4 of the case, bottles 7 are held so that during transport they cannot tip and also cannot hit one another. By reason of variation in the size of the bottles and often great deviation from exact roundness, it is necessary in this embodiment of the invention to space the bottles at a relatively great distance from one another.

Figure 6:
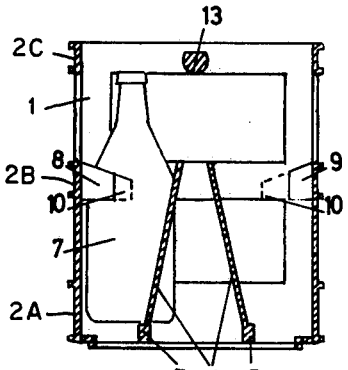
FIGS. 6 and 7 are cross sections of two other embodiments of bottle cases in accordance with the invention.
Figure 7:
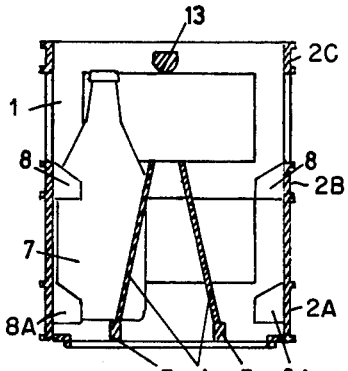
Figure 8:
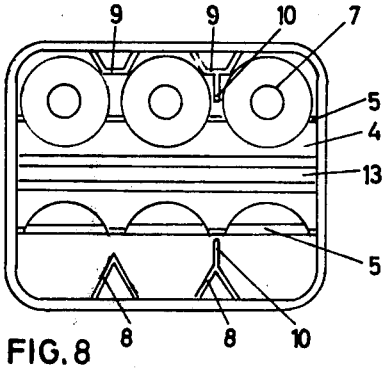
FIG. 8 is a plan view of the bottle cases shown in FIGS. 6 and 7.

A much closer spacing of the bottles can be attained by the embodiment of the invention illustrated in FIGS. 6 to 8. In this embodiment, the middle side bands 2B at the sides of the case are provided at locations between adjacent bottles with projections 8 which in plan view are triangular in cross section and which extend into the interior of the case between adjacent bottles so as to support the bottles on the side opposite to that engaged by the inner walls. Similar projections 8A can also be provided on the lower side bands 2A if desired. Instead of the triangular projections 8 there may be projections 9 which in plan are of trapezoidal cross section. In FIG. 8, triangular projections 8 are shown on one side of the case and trapezoidal projections 9 are shown on the opposite side of the case. However, in actual practice, all of the projections of a case are normally of one kind. In all cases, it is desirable for the upper edges of the triangular or trapezoidal projections to be inclined inwardly and downwardly as seen in FIGS. 6 and 7 so as to facilitate the insertion of bottles into the case.

Additionally, inwardly extending inner wall pieces 10 can be provided on the projections 8 and 9 as shown in broken lines in FIG. 6 and on two of the projections in FIG. 8. The inner wall pieces 10 extend inwardly to a point spaced from the side walls a distance equal to approximately half the diameter of the bottles 7 so as to lie between adjacent bottles and prevent them from bumping one another.

Figure 9:
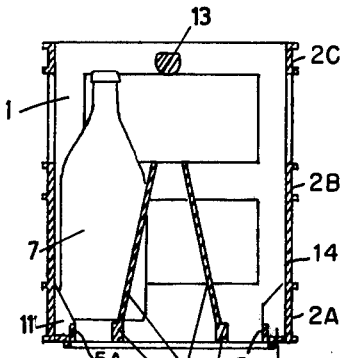
FIG. 9 is a cross section of a further embodiment.
Figure 10:
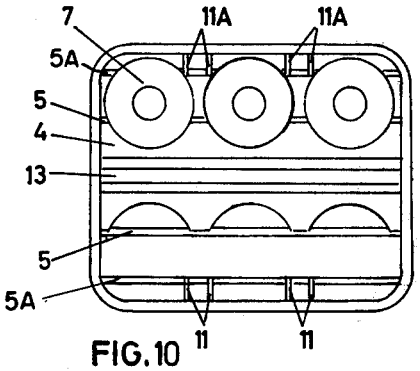
FIG. 10 is a plan view of the bottle case shown in FIG. 9.

In the embodiment shown in FIGS. 9 and 10, pairs of projections 11 extend into the interior of the bottle case from the lower side bands 2A at locations between adjacent bottles. As seen in FIG. 9, these projections can be of triangular shape or trapezoidal shape as seen in elevation looking parallel with the sides of the case. At the left hand side in FIG. 9 there are shown triangular projections 11 while at the right hand side there are shown trapezoidal projections 11A. The projections 11, 11A are positioned as illustrated in FIG. 10 so as to engage the bottles 7 and hold them apart. The projections 11, 11A illustrated in FIGS. 9 and 10 can, if desired be combined with projections such as 8 or 9 on the middle side bands of the bottle case as illustrated in FIGS. 6 to 8 which may further be provided with inwardly extending inner wall pieces 10. Moreover, if the case is intended for heavy bottles, a further supporting ledge or bar 5A may extend between opposite ends of the case and be joined with the lower inner edges of the projections 11, 11A so as to provide additional support for the bottles.

Figure 11:
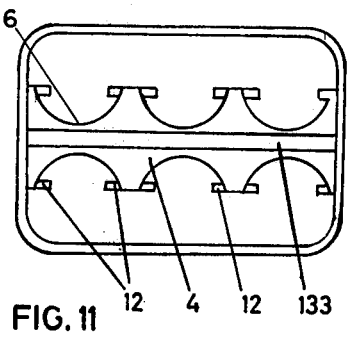
FIG. 11 is a plan view of a further embodiment.
Figure 12:
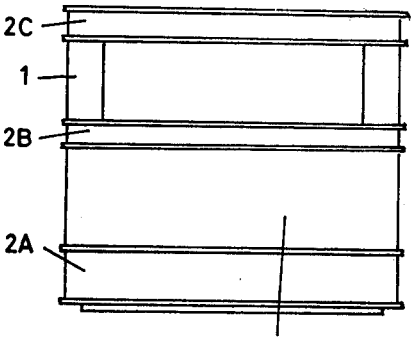
FIG. 12 is a side view of the bottle cases shown in FIGS. 6 to 10.

In a further embodiment of the invention as illustrated in FIG. 11, the bottom ledges 5 which extend continuously from one end of the bottle case to the other are replaced by bar portions 12 which are provided on the lower edges of the inner walls 4 and extend only part way across the bottoms of the openings 6. These bar portions 12 have the effect that bottles of a smaller diameter than those for which the case is intended drop out through the bottom of the case. Likewise, pieces of broken bottles fall out through the bottom so that when the bottle case is unloaded by an unloading machine, only unbroken bottles of the right size are unloaded. The broken glass falls out so that without further control, proper loading of the empty bottle case with new bottles is possible.

While making the sides and ends of the bottle case of spaced horizontal bands as illustrated in FIGS. 1 to 5 has the advantage of saving material, the walls can if desired be made solid. Alternatively, the lower portion of the sides and ends of the case may be enclosed by wall portions 14 between the lower bands 2A, 3A and the middle bands 2B, 3B as illustrated in FIGS. 6, 7, 9 and 12. A further possibility is to have the enclosing wall portions 14 only on the long sides of the case while leaving the ends open.

Bottle cases in accordance with the present invention are suitable not only for storage and transport of round bottles but also bottles of square or other shape. In this event the openings 6 in the inner walls 4 are shaped to conform to the cross sectional shape of the bottles.

This construction of the bottle case is primarily intended for bottle cases in which two rows of bottles are inserted. However, it is also applicable to bottle cases for more bottles and particularly for the two outer rows of bottles. Further rows of bottles between the two outer rows are then positioned between two inner walls 4 which are similarly arranged in V-form so that they converge downwardly.

While preferred embodiments of the invention have been illustrated in the drawings and are herein particularly described, it will be understood that many modifications can be made and that the invention is hence in no way limited to the illustrated embodiments.

What I claim is:

1. A one piece plastic bottle case in which bottles are arranged in two rows, said case comprising opposite sides and opposite ends, two inner walls which extend between opposite ends of the case and slope upwardly and inwardly at an acute angle to one another, lower edges of said inner walls being spaced inwardly from the respective sides of the case a distance less than the width of bottles to be received in the case, said inner walls having therein openings to receive bottles, said openings in horizontal projection conforming to the cross sectional shape of said bottles, and ledges at the bottoms of said openings to support bottles received in said openings, the bottom of said case being otherwise open.

2. A plastic bottle case according to claim 1, in which said inner walls are spaced apart and a handle extending longitudinally between opposite ends of the case is disposed above the space between said inner walls.

3. A plastic bottle case according to claim 1, in which said case is in the form of a frame comprising four corner columns and on each side and end at least three horizontal bands extending between the respective corner columns.

4. A plastic bottle case according to claim 3, in which said bands comprise a lower band, a middle band and an upper band and in which projections on the middle bands of opposite sides of the case extend into the interior of the case in position to be between bottles in the case so as to separate the bottles.

5. A plastic bottle case according to claim 4, in which said projections in plan are of triangular shape.

6. A plastic bottle case according to claim 4, in which said projections in plan are of trapezoidal shape.

7. A plastic bottle case according to claim 4, in which upper edges of said projections are inclined inwardly and downwardly to facilitate entry of bottles into the case.

8. A plastic bottle case according to claim 4, in which projections on the lower bands of opposite sides of the case extend into the interior of the case in position to be between bottles in the case to separate the bottles.

9. A plastic bottle case according to claim 4, in which inner wall pieces extend inwardly from said projections in position to lie between adjacent bottles in the case to prevent said bottles from bumping one another.

10. A plastic bottle case according to claim 1, in which pairs of projections project into the interior of the case from lower portions of opposite sides of the case in position to be between adjacent bottles in the case to position the bottles apart and prevent them from bumping one another.

11. A plastic bottle case according to claim 10, in which further bottom ledges extend between opposite ends of the case and join lower inner portions of said projections, said ledges providing further support for bottles in the case.

12. A plastic bottle case according to claim 1, in which said ledges are interrupted so as to extend only part way across each of said inner wall openings from opposite sides thereof so as to support bottles of the size for which the case is intended but to allow smaller bottles or pieces of broken bottles to drop out through the bottom of the case.

13. A plastic bottle case according to claim 3, in which said bands comprise lower bands, middle bands and upper bands and in which integral wall portions extend between said lower bands and middle bands only, the sides and ends of the case being open between the middle bands and upper bands.

* * * * *